US007647008B2

(12) United States Patent
Landa et al.

(10) Patent No.: US 7,647,008 B2
(45) **Date of Patent: *Jan. 12, 2010**

(54) IMAGING APPARATUS AND IMPROVED TONER THEREFOR

(75) Inventors: Benzion Landa, Nes-Ziona (IL); Peretz Ben-Avraham, Rehovot (IL); Becky Bossidan, Rishon-Lezion (IL); Amiran Lavon, Bat-Yam (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

This patent is subject to a terminal disclaimer.

(21) Appl. No.: 11/933,124

(22) Filed: Oct. 31, 2007

(65) Prior Publication Data

US 2008/0056779 A1 Mar. 6, 2008

(51) Int. Cl.
*G03G 15/10* (2006.01)

(52) U.S. Cl. ..... 399/237; 399/333; 399/302; 399/308; 430/114; 430/116

(58) Field of Classification Search ..... 399/237, 399/233, 302, 308; 430/114, 116, 137.22, 430/45.2

See application file for complete search history.

(56) References Cited

U.S. PATENT DOCUMENTS

| | | | |
|---|---|---|---|
| 3,058,914 | A | 10/1962 | Metcalfe et al. |
| 3,535,244 | A | 10/1970 | Zabiak |
| 3,862,848 | A | 1/1975 | Marley |
| 3,893,417 | A | 7/1975 | York |
| 4,005,022 | A | 1/1977 | Vijayendran |
| 4,413,048 | A | 11/1983 | Landa |
| 4,476,210 | A | 10/1984 | Croucher et al. |
| 4,531,825 | A | 7/1985 | Miwa et al. |
| 4,659,640 | A | 4/1987 | Santilli |
| 4,684,238 | A | 8/1987 | Till et al. |
| 4,690,539 | A | 9/1987 | Radulski et al. |

(Continued)

FOREIGN PATENT DOCUMENTS

| | | |
|---|---|---|
| DE | 2507703 | 8/1975 |

(Continued)

OTHER PUBLICATIONS

Aldrich Catalog, "Aldrich Chemical Company" Inc., 1994, pp. 622 and 1066.

(Continued)

*Primary Examiner*—David M Gray
*Assistant Examiner*—G. M. Hyder

(57) ABSTRACT

The invention relates to a liquid toner and imaging apparatus provided with an imaging surface having a liquid toner image formed thereon on fibrous toner particles and carrier liquid. The fibrous toner particles can be composed of a polymer portion and pigment dispersed therein, where the polymer portion comprises a surface of the fibrous toner particles and is insoluble in the carrier liquid at temperatures below 40° C., so that the polymer portion will not dissolve or solvate in storage. The polymer portion also is solvatable by the carrier liquid only at temperatures above 50° C. The carrier liquid has, as a major component, first liquid hydrocarbon having a first rate of evaporation, and, as a minor component, second liquid hydrocarbon having a second rate of evaporation which, at room temperature, is at least an order of magnitude less than the first rate of evaporation.

7 Claims, 7 Drawing Sheets

U.S. PATENT DOCUMENTS

| | | | |
|---|---|---|---|
| 4,794,651 | A | 12/1988 | Landa et al. |
| 4,976,923 | A | 12/1990 | Lipsky et al. |
| 4,984,025 | A | 1/1991 | Landa et al. |
| 4,985,732 | A | 1/1991 | Landa et al. |
| 5,028,507 | A | 7/1991 | Kidnie |
| 5,047,808 | A | 9/1991 | Landa et al. |
| 5,089,856 | A | 2/1992 | Landa et al. |
| 5,117,263 | A | 5/1992 | Adam et al. |
| 5,192,638 | A | 3/1993 | Landa et al. |
| 5,200,290 | A | 4/1993 | Ong et al. |
| 5,208,130 | A | 5/1993 | Almog et al. |
| 5,225,306 | A | 7/1993 | Almog et al. |
| 5,232,811 | A | 8/1993 | deGraft-Johnson et al. |
| 5,255,058 | A | 10/1993 | Pinhas et al. |
| 5,264,313 | A | 11/1993 | Landa et al. |
| 5,266,435 | A | 11/1993 | Almog |
| 5,276,492 | A | 1/1994 | Landa et al. |
| 5,278,612 | A | 1/1994 | Inui |
| 5,278,615 | A | 1/1994 | Landa |
| 5,280,326 | A | 1/1994 | Pinhas et al. |
| 5,286,593 | A | 2/1994 | Landa et al. |
| 5,289,238 | A | 2/1994 | Lior et al. |
| 5,300,390 | A | 4/1994 | Landa et al. |
| 5,335,054 | A | 8/1994 | Landa et al. |
| 5,346,796 | A | 9/1994 | Almog |
| 5,378,574 | A | 1/1995 | Winnik et al. |
| 5,384,225 | A | 1/1995 | Kurotori et al. |
| 5,492,788 | A | 2/1996 | Denton et al. |
| 5,508,790 | A | 4/1996 | Belinkov et al. |
| 5,529,847 | A | 6/1996 | Chen et al. |
| 5,551,453 | A | 9/1996 | Sturla |
| 5,555,185 | A | 9/1996 | Landa |
| 5,557,376 | A | 9/1996 | Landa et al. |
| 5,572,274 | A | 11/1996 | Lior et al. |
| 5,573,883 | A | 11/1996 | Berkes et al. |
| 5,592,269 | A | 1/1997 | Younes et al. |
| 5,636,349 | A | 6/1997 | Landa et al. |
| 5,642,188 | A | 6/1997 | Mochizuki et al. |
| 5,708,937 | A * | 1/1998 | Lestrange et al. ..... 399/239 |
| 5,745,829 | A | 4/1998 | Gazit et al. |
| 5,998,081 | A | 12/1999 | Morrison et al. |
| 6,479,205 | B1 * | 11/2002 | Landa et al. ..... 430/116 |

FOREIGN PATENT DOCUMENTS

| | | |
|---|---|---|
| EP | 0062482 | 10/1982 |
| EP | 0098084 | 1/1984 |
| EP | 0426392 | 5/1991 |
| JP | 57/074764 | 11/1982 |
| JP | 03083074 | 4/1991 |
| JP | 06-222678 | 8/1994 |
| WO | WO9014619 | 11/1990 |
| WO | WO9402887 | 2/1994 |
| WO | WO9613760 | 5/1996 |

OTHER PUBLICATIONS

Andrews, F.C., "Thermodynamics: Principles and Applications". Wiley-Interscience, NY (1971), pp. 167-169.

ASTM Designation: D2879 96, Standard Test For Vapor Pressure-Temperature Relationship and Initial Decomposition Temperature of Liquid by Isoteniscope, Copyrighted Jun. 1997, pp. 1-6.

CAS File Registry No. 25053-53-6, Copyright 2000.

Diamond, A.S. ed. "HandBook Of Imaging Materials", Marcel Dekker, Inc, NY (1991), p. 233.

Moelwyn-Hughes, E.A. "Physical Chemistry", Second Revision Edition, Pergamon Press, NY (1965), pp. 702-703.

Neufeldt, V. et al, ed. "Webster's New World Dictionary", Third College Edition, Simon & Schuster, NY (1988), p. 1165.

Patent & Trademark Office English Language Translation of JP Patent 03-204656 (Pub. Sep. 1991).

The Aldrich Chemical Co. Catalog, 1994, p. 1123, 715, & 1462.

Trademark Electronic Search System (TESS) printout of Mar. 12, 2007, describing the US registered trademark MARCOL, registration date Nov. 7, 1922.

Trademark Electronic Search System (TESS) printout of Mar. 12, 2007, describing the US registered trademark ISOPAR, registration date Nov. 5, 1963.

* cited by examiner

IMAGING APPARATUS AND IMPROVED TONER THEREFOR

RELATED APPLICATIONS

This patent application claims priority to, and is related to, U.S. patent application Ser. No. 10/291,383, now U.S. Pat. No. 7,354,691 titled "Imaging Apparatus and Improved Toner Therefor", filed on 11/12/2002, commonly assigned herewith, and hereby incorporated by reference, which claims priority and is a continuation of U.S. application Ser. No. 10/291,384 filed on 11/12/2002 of same title, which was a continuation application claiming priority to U.S. application Ser. No. 08/809,419 filed on Jun. 5, 1997, which was filed under 35 U.S.C. 371 as the national stage of International application PCT/NL 95/00030, filed Jan. 20, 1995. The PCT application itself claiming priority to Application No. 111440, filed 28 Oct. 1994 in Israel. The U.S. Pat. No. 08/809,419 application having issued on Nov. 12, 2002 as U.S. Pat. No. 6,479,205 B1.

FIELD OF THE INVENTION

The present invention relates to image forming and image transfer apparatus especially for use in electrostatic imaging using an intermediate transfer blanket and to toner materials especially useful for electrostatic imaging using an intermediate transfer member.

BACKGROUND OF THE INVENTION

The use of an intermediate transfer member in electrostatic imaging is well known. Generally, toner materials for use with such blankets are similar to those used for direct transfer from a photoreceptor to a final substrate, such as paper.

Various types of intermediate transfer members are known and are described, for example in U.S. Pat. Nos. 3,862,848, 4,684,238, 4,690,539, 4,531,825, 4,984,025, 5,047,808, 5,089,856, 5,335,054, U.S. Pat. applications U.S. Ser. No. 08/116,198, METHOD AND APPARATUS FOR IMAGING USING AN INTERMEDIATE TRANSFER MEMBER, filed Sep. 3, 1993, now U.S. pat. No. 5,636,349; U.S. Ser. No. 07/400,717, METHOD AND APPARATUS FOR IMAGING USING AN INTERMEDIATE TRANSFER MEMBER, filed Aug. 30, 1989, now U.S. Pat. No. 5,555,185; U.S. Ser. No. 08/151,803 LIQUID DEVELOPER IMAGING SYSTEM HAVING A HEATED INTERMEDIATE TRANSFER MEMBER, filed Sep. 3, 1993, now U.S. Pat. No. 5,572,274; U.S. Ser. No. 07/351,546 COLOR IMAGING SYSTEM, filed May 15, 1989, now U.S. Pat. No. 5,557,376 and U.S. patent application Ser. No. 08/321,538 filed Oct. 11, 1994 titled IMAGING APPARATUS AND INTERMEDIATE TRANSFER MEMBER THEREFOR to David EDAN et al., the specifications of all of which are incorporated herein by reference.

Removable intermediate transfer blankets for attachment to a drum for use in electrostatic images are described in a number of the above referenced patents and applications.

It has been found that the lifetime of such blankets appears to be limited at least in part by loss of surface properties of the blanket. In particular, such blankets are generally coated with a release layer, preferably a silicone release material. It appears that the release properties of the release material deteriorates with use.

In U.S. Pat. No. 5,192,638, the specification of which is incorporated herein in its entirety, Landa et al introduced a new liquid toner comprising a carrier liquid such as a light mineral oil and pigmented toner particles having fibrous extensions. The mineral oils described in the above referenced patent were ISOPAR L and M™ type saturated hydrocarbon liquids having a high Kauri-Butanol number and a high resistivity. Many other mineral oils such as MARCOL 82 or other carrier liquids for liquid toner as are known in the art, are also suitable for the toner type of U.S. Pat. No. 5,192,638, depending on the overall characteristics specified for the toner. MARCOL 82 has a very low volatility and images produced from toners that use Marcol 82 generally have poor abrasion resistance.

A characteristic of these toners is that they solvate the carrier liquid at elevated temperatures but are substantially insoluble in the carrier liquid at room temperature. Other patents and publications that describe preferred embodiments of this toner type and additives useful in the toner are U.S. Pat. Nos. 5,300,390; 5,286,593; 5,208,130;, 5,266,435; 5,264,313; and 5,225,306 and in PCT publications WO 94/02887 the disclosures of which are incorporated herein by reference.

SUMMARY OF THE INVENTION

The present invention seeks to provide, in one aspect thereof, improved image transfer apparatus using an intermediate transfer member and a liquid toner and having an improved longevity of the intermediate transfer member.

The present invention further seeks to provide, in a second aspect thereof, an improved liquid toner that, when used with an intermediate transfer member results in an improvement in the life of the intermediate transfer member over what it would have been with prior art toners.

The present invention further seeks to provide, in a third aspect thereof, liquid toner components for use in the liquid toner of the invention.

There is thus provided in accordance with a preferred embodiment of the invention, imaging apparatus comprising:

an imaging surface having a liquid toner image formed thereon, said image comprising toner particles and carrier liquid, wherein the carrier liquid comprises as a major component, a liquid, preferably a liquid hydrocarbon, that evaporates relatively quickly at room temperature, and as a minor component, a liquid, preferably a liquid hydrocarbon, that evaporates relatively slowly at room temperature; and an intermediate transfer member having a release outer layer that receives the toner image from the imaging surface and from which it is subsequently transferred.

There is further provided in accordance with a preferred embodiment of the invention, an imaging apparatus comprising:

an imaging surface having a liquid toner image formed thereon, said image comprising fibrous toner particles and carrier liquid, said fibrous toner particles comprising a polymer portion and pigment dispersed in said polymer portion, said polymer portion comprising a surface of said fibrous toner particles and being insoluble in said carrier liquid at temperatures below 40° C. so that the polymer portion will not dissolve or solvate in storage, and solvatable by said carrier liquid only at temperatures above 50° C., and said carrier liquid comprising, as a major component, first liquid hydrocarbon having a first rate of evaporation, and, as a minor component, second liquid hydrocarbon having a second rate of evaporation which, at room temperature, is at least an order of magnitude less than the first rate of evaporation; and an intermediate transfer member having a release outer layer that is capable of receiving toner images from the imaging surface and subsequently transferring the images to a further surface.

Preferably, the release outer layer solvates the carrier liquid and is swelled by it.

There is further provided in accordance with a preferred embodiment of the invention a liquid developer comprising:

toner particles; and carrier liquid, wherein the carrier liquid comprises as a major component, a liquid, preferably a liquid hydrocarbon, that evaporates relatively quickly at room temperature, and as a minor component, a liquid, preferably a liquid hydrocarbon, that evaporates very slowly at room temperature.

There is further provided in accordance with a preferred embodiment of the invention, a liquid toner comprising:

fibrous toner particles and carrier liquid;

said carrier liquid comprising, as a major component, first liquid hydrocarbon having a first rate of evaporation, and, as a minor component, second liquid hydrocarbon having a second rate of evaporation which, at room temperature, is at least an order of magnitude less than the first rate of evaporation; and said fibrous toner particles comprising a polymer portion and pigment dispersed in said polymer portion, said polymer portion comprising a surface of said fibrous toner particles and being insoluble in said carrier liquid at temperatures below 40° C. so that the polymer portion will not dissolve or solvate in storage, and solvatable by said carrier liquid only at temperatures above 50° C.

Preferably, said minor component comprises between 0.2 and 2% and wherein said major component comprises between 98% and 99.7% of the total amount of said carrier liquid.

Preferably, the major component evaporates at least about an order of magnitude more quickly than the minor component.

Preferably, the major component has a vapor pressure at 100° F. of greater than 0.05 psia when measured according to ASTM standard D 2879.

There is further provided, in accordance with a preferred embodiment of the invention, a mixture of liquid hydrocarbons substantially comprising between 0.5 and 4% of a substantially non-conducting liquid, preferably, a liquid hydrocarbon, that evaporates very slowly at room temperature and between 96 and 99.5 percent by weight of a substantially non-conducting liquid, preferably a liquid hydrocarbon, that evaporates at least an order of magnitude more quickly.

Preferably, the mixture further comprises a charge director for liquid toner particles.

In a preferred embodiment of the invention, the carrier liquids are hydrocarbons wherein the hydrocarbon that evaporates relatively quickly has a vapor pressure at 100° F. of greater than 0.05 psia when measured according to ASTM standard D 2879 and a 95% evaporation time at room temperature of less than 10 hours, preferably, less than 6 hours and the liquid hydrocarbon that evaporates relatively slowly has an evaporation time at least about an order of magnitude greater than 10 hours. Alternatively, other carrier liquids suitable for use in liquid toners such as fluorocarbons, silicones, etc., may be used in the practice of the broadest aspects of the invention.

In a preferred embodiment of the invention the release coating absorbs the carrier liquid and is swelled by it.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
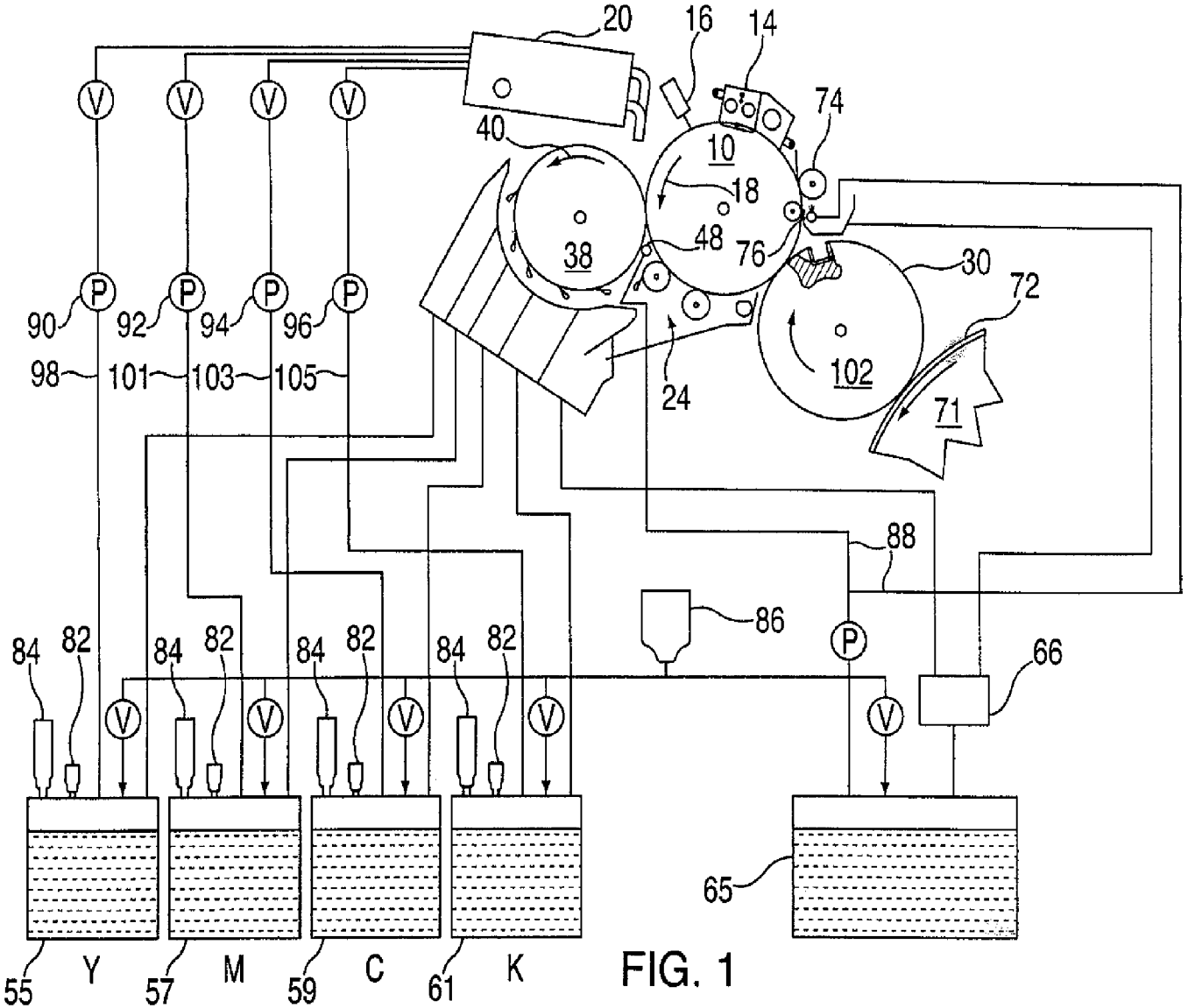
FIG. 1 is a simplified sectional illustration of electrostatic imaging apparatus constructed and operative in accordance with a preferred embodiment of the present invention.
Figure 2:
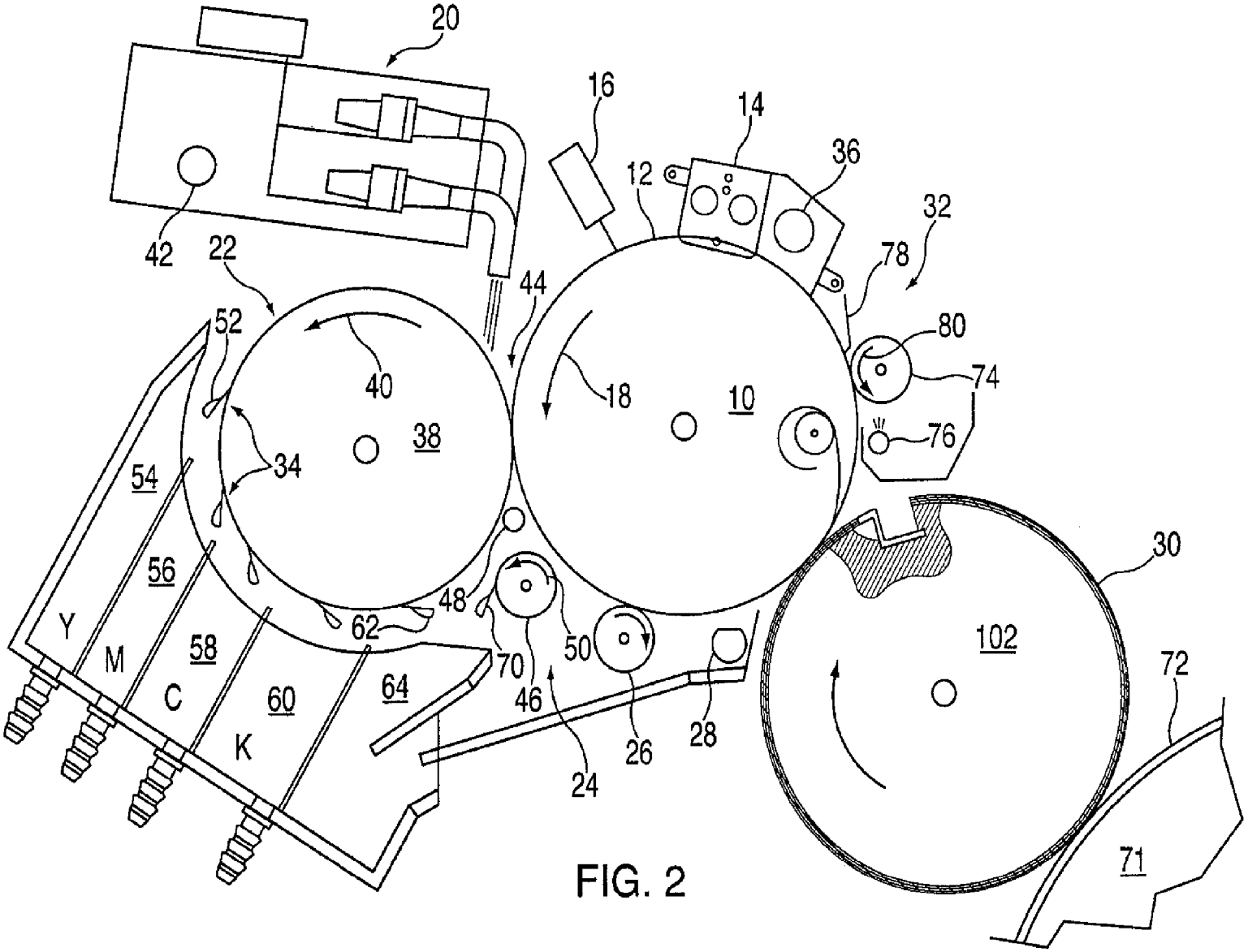
FIG. 2 is a-simplified enlarged sectional illustration of the apparatus of FIG. 1.

Reference is now made to FIGS. 1 and 2 which illustrate a multicolor electrostatic imaging system constructed and operative in accordance with a preferred embodiment of the present invention. As seen in FIGS. 1 and 2 there is provided an imaging sheet, preferably an organic photoreceptor 12, typically mounted on a rotating drum 10. Drum 10 is rotated about its axis by a motor or the like (not shown), in the direction of arrow 18, past charging apparatus 14, preferably a corotron, scorotron or roller charger or other suitable charging apparatus as are known in the art and which is adapted to charge the surface of sheet photoreceptor 12. The image to be reproduced is focused by an imager 16 upon the charged surface 12 at least partially discharging the photoconductor in the areas struck by light, thereby forming the electrostatic latent image. Thus, the latent image normally includes image areas at a first electrical potential and background areas at another electrical potential.

Photoreceptor sheet 12 may use any suitable arrangement of layers of materials as is known in the art, however, in the preferred embodiment of the photoreceptor sheet, certain of the layers are removed from the ends of the sheet to facilitate its mounting on drum 10.

This preferred photoreceptor sheet and preferred methods of mounting it on drum 10 are described in a co-pending application of Belinkov et al., IMAGING APPARATUS AND PHOTORECEPTOR THEREFOR, filed Sep. 7, 1994, assigned Ser. No. 08/301,775, now U.S. Pat. No. 5,508,790 the disclosure of which is incorporated herein by reference. Alternatively, photoreceptor 12 may be deposited on the drum 10 and may form a continuous surface. Furthermore, photoreceptor 12 may be a non-organic type photoconductor based, for example, on a compound of Selenium.

Imaging apparatus 16 may be a modulated laser beam scanning apparatus, an optical focusing device for imaging a copy on a drum or other imaging apparatus such as is known in the art.

Also associated with drum 10 and photoreceptor sheet 12, in the preferred embodiment of the invention, are a multicolor liquid developer spray assembly 20, a developing assembly 22, color specific cleaning blade assemblies 34, a background cleaning station 24, an electrified squeegee 26, a background discharge device 28, an intermediate transfer member 30, cleaning apparatus 32, and, optionally, a neutralizing lamp assembly 36.

Developing assembly 22 preferably includes a development roller 38. Development roller 38 is preferably spaced from photoreceptor 12 thereby forming a gap therebetween of typically 40 to 150 micrometers and is charged to an electrical potential intermediate that of the image and background areas of the image. Development roller 38 is thus operative, when maintained at a suitable voltage, to apply an electric field to aid development of the latent electrostatic image.

Development roller 38 typically rotates in the same sense as drum 10 as indicated by arrow 40. This rotation provides for the surface of sheet 12 and development roller 38 to have opposite velocities at the gap between them.

Multicolor liquid developer spray assembly 20, whose operation and structure is described in detail in U.S. Pat. No. 5,117,263, the disclosure of which is incorporated herein by reference, may be mounted on axis 42 to allow assembly 20 to be pivoted in such a manner that a spray of liquid toner containing electrically charged pigmented toner particles can be directed either onto a portion of the development roller 38, a portion of the photoreceptor 12 or directly into a development region 44 between photoreceptor 12 and development roller 38. Alternatively, assembly 20 may be fixed. Preferably, the spray is preferably directed onto a portion of the development roller 38.

Color specific cleaning blade assemblies 34 are operatively associated with developer roller 38 for separate removal of residual amounts of each colored toner remaining thereon after development. Each of blade assemblies 34 is selectably brought into operative association with developer roller 38 only when toner of a color corresponding thereto is supplied to development region 44 by spray assembly 20. The construction and operation of cleaning blade assemblies is described in PCT Publication WO 90/14619 and in U.S. Pat. No. 5,289,238, the disclosures of which are incorporated herein by reference.

Each cleaning blade assembly 34 includes a toner directing member 52 that serves to direct the toner removed by the cleaning blade assemblies 34 from the developer roller 38 to separate collection containers 54, 56, 58, and 60 for each color to prevent contamination of the various developers by mixing of the colors. The toner collected by the collection containers is recycled to a corresponding toner reservoir (55, 57, 59 and 61). A final toner directing member 62 always engages the developer roller 38 and the toner collected thereat is supplied into collection container 64 and thereafter to reservoir 65 via separator 66 that is operative to separate relatively clean carrier liquid from the various colored toner particles. The separator 66 may be typically of the type described in U.S. Pat. No. 4,985,732, the disclosure of which is incorporated herein by reference.

In a preferred embodiment of the invention, as described in U.S. Pat. No. 5,255,058, the disclosure of which is incorporated herein by reference, where the imaging speed is very high, a background cleaning station 24 typically including a reverse roller 46 and a fluid spray apparatus 48 is provided. Reverse roller 46 which rotates in a direction indicated by arrow 50 is electrically biased to a potential intermediate that of the image and background areas of photoconductive drum 10, but different from that of the development roller. Reverse roller 46 is preferably spaced apart from photoreceptor sheet 12 thereby forming a gap therebetween that is typically 40 to 150 micrometers.

Fluid spray apparatus 48 receives liquid toner from reservoir 65 via conduit 88 and operates to provide a supply of preferably non-pigmented carrier liquid to the gap between sheet 12 and reverse roller 46. The liquid supplied by fluid spray apparatus 48 replaces the liquid removed from drum 10 by development assembly 22 thus allowing the reverse roller 46 to remove charged pigmented toner particles by electrophoresis from the background areas of the latent image. Excess fluid is removed from reverse roller 46 by a liquid directing member 70 that continuously engages reverse roller 46 to collect excess liquid containing toner particles of various colors which is in turn supplied to reservoir 65 via a collection container 64 and separator 66.

The apparatus embodied in reference numerals 46, 48, 50 and 70 is not required for low speed systems, but is preferably included in high speed systems.

Preferably, an electrically biased squeegee roller 26 is urged against the surface of sheet 12 and is operative to remove liquid carrier from the background regions and to compact the image and remove liquid carrier therefrom in the image regions. Squeegee roller 26 is preferably formed of resilient slightly conductive polymeric material as is well known in the art, and is preferably charged to a potential of several hundred to a few thousand volts with the same polarity as the polarity of the charge on the toner particles.

Discharge device 28 is operative to flood the sheet 12 with light that discharges the voltage remaining on sheet 12, mainly to reduce electrical breakdown and improve transfer of the image to intermediate transfer member 30. Operation of such a device in a write black system is described in U.S. Pat. No. 5,280,326, the disclosure of which is incorporated herein by reference.

FIGS. 1 and 2 further show that multicolor toner spray assembly 20 receives separate supplies of colored toner typically from four different reservoirs 55, 57, 59 and 61. FIG. 1 shows four different colored toner reservoirs 55, 57, 59 and 61 typically containing the colors Yellow, Magenta, Cyan and, optionally, Black respectively. Pumps 90, 92, 94 and 96 may be provided along respective supply conduits 98, 101, 103 and 105 for providing a desired amount of pressure to feed the colored toner to multicolor spray assembly 20. Alternatively, multicolor toner spray assembly 20, which is preferably a three level spray assembly, receives supplies of colored toner from up to six different reservoirs (not shown) which allows for custom colored tones in addition to the standard process colors.

Additionally, in response to measurements of the liquid toner in reservoirs 55, 57, 59 and 61, toner concentrate from concentrate containers 84, charge director concentrate from containers 82 and replenishment liquid from container 86 are added to the respective reservoirs. In particular, as is well known in the art, toner concentrate is added to the reservoirs in response to a reduced concentration of toner particles in the reservoirs. As is well known in the art, such concentration is preferably measured optically. Charge director Is added in response to reduced conductivity of the toner in the reservoirs. Replenishment liquid is added in response to a reduction in the volume of liquid in the reservoirs.

A preferred type of toner for use with the present invention is that described in Example 1 of U.S. Pat. No. 4,794,651, the disclosure of which is incorporated herein by reference or variants thereof as are well known in the art and as are described in the patents, applications and publications listed in the Background of the Invention. Preferably the liquid toner is manufactured by one of the methods described in these patents applications and publications. For colored liquid developers, carbon black is replaced by color pigments as is well known in the art. Other liquid toners may alternatively be employed.

While the invention is useful for a wide range of toner types preferred toners of the present invention have the following formulations:

Black toner—about 16% NUCREL 925 (ethylene copolymer by DUPONT), about 0.4% BT583D (blue pigment produced by Cookson Pigments), about 4% MOGUL L carbon black (Cabot), approximately 0.45% aluminum tristearate and charge director as described in U.S. patent application Ser. No. 07/915,291 (utilizing lecithin, BBP and ICI G3300B) and in WO 94/02887 in an amount equal to 40 mg/gm of solids and the remainder 99.5% ISOPAR L and 0.5% MARCOL 82.

Magenta toner—about 15.5% BYNELL 2002 (ethylene terpolymer by DUPONT), about 2.8% FINESS Re F2B magenta pigment (Toyo Ink), about 0.14% SICO FAST YELLOW D1355DD yellow Pigment (BASK) approximately 0.45% aluminum tristearate and charge director as described in U.S. patent application Ser. No. 07/915,291, now U.S. Pat. No. 5,346,796 (utilizing lecithin, BBP and ICI G3300B) and in WO 94/02887 in an amount equal to 40 mg/gm, of solids and the remainder 99.5% ISOPAR L and 0.5% MARCOL 82.

Cyan toner has a composition similar to that of the magenta toner except that 2.36% of BT583D pigment (Cookson replaces the magenta pigment and the yellow pigment is reduced to 0.03%. The composition of the yellow toner is similar to that of the black toner except that 3.13% of yellow pigment is substituted for the pigment and carbon black of the black toner.

It should be understood that the invention is not limited to the specific type of image forming system used and the present invention is also useful with any suitable imaging system that forms a liquid toner image on an image forming surface and transfers the image to an intermediate transfer member for subsequent transfer to a final substrate.

The specific details given above for the image forming system are included as part of a best mode of carrying out the invention, however, many aspects of the invention are applicable to a wide range of systems as known in the art for printing and copying using liquid toners.

Intermediate transfer member 30, an especially preferred embodiment of which is described the above referenced application of EDAN et al., may be any suitable intermediate transfer member having a multilayered transfer portion such as those described in the U.S. patents and patent applications incorporated above by reference. Furthermore, the blanket may be replaceable as described in the EDAN et al. application and may be mounted by any convenient means on the drum. Preferred mounting means for the blanket is shown in the EDAN et al. application.

Figure 3A:
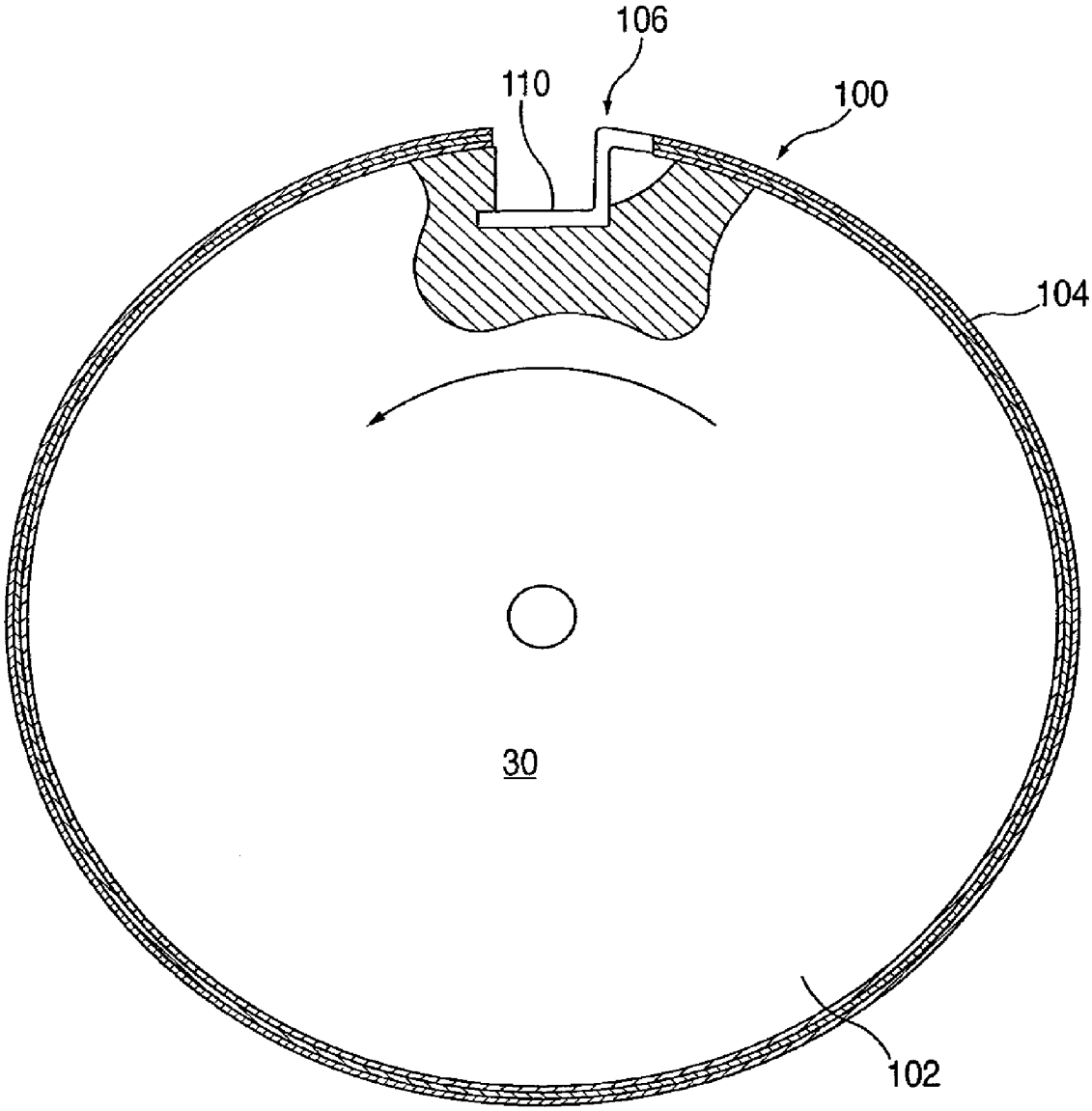
FIG. 3A is a simplified, cross-sectional side view of an intermediate transfer member, including a removable intermediate transfer blanket mounted on a drum, in accordance with a preferred embodiment of the invention.
Figure 3B:
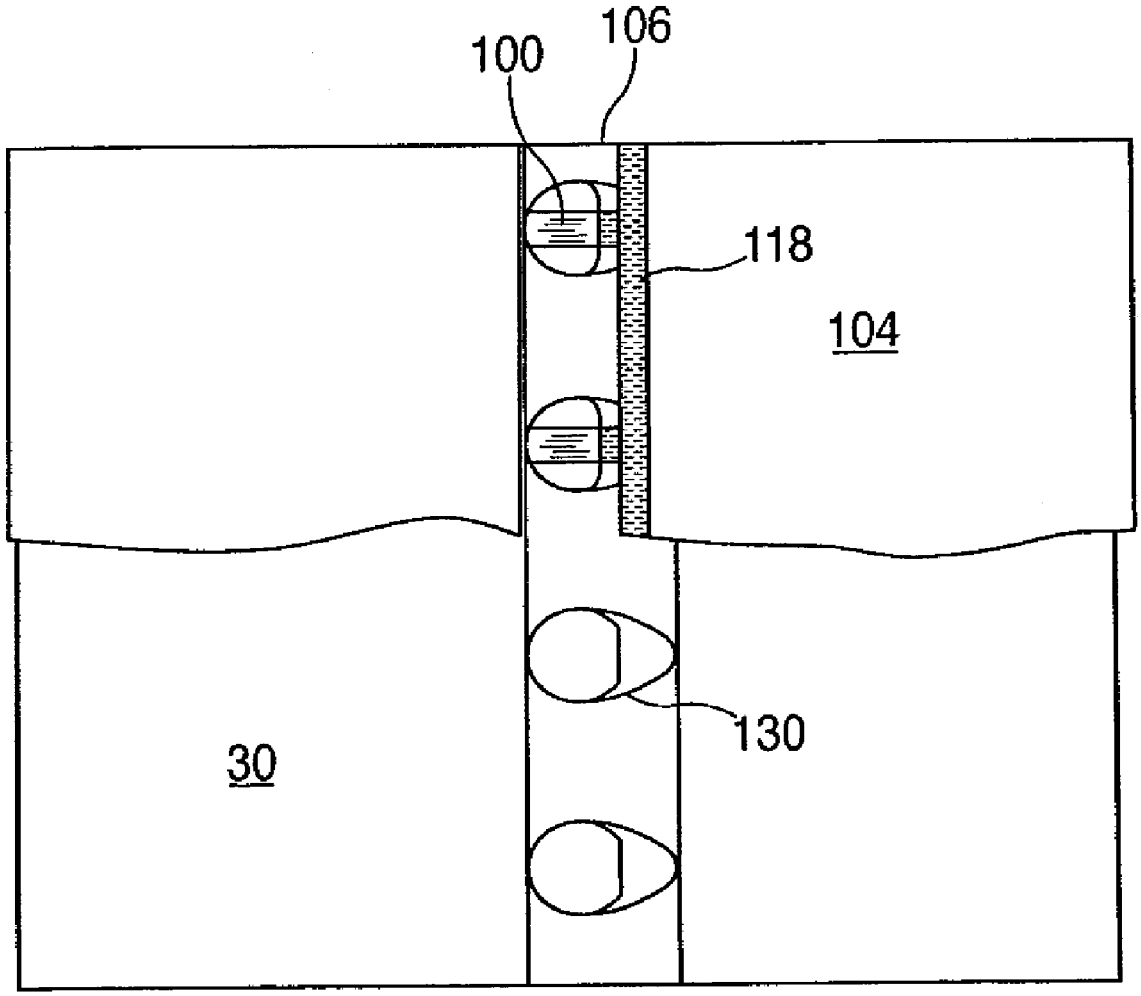
FIG. 3B is a partially cut-away top view of the intermediate transfer member of FIG. 3A.
Figure 4A:
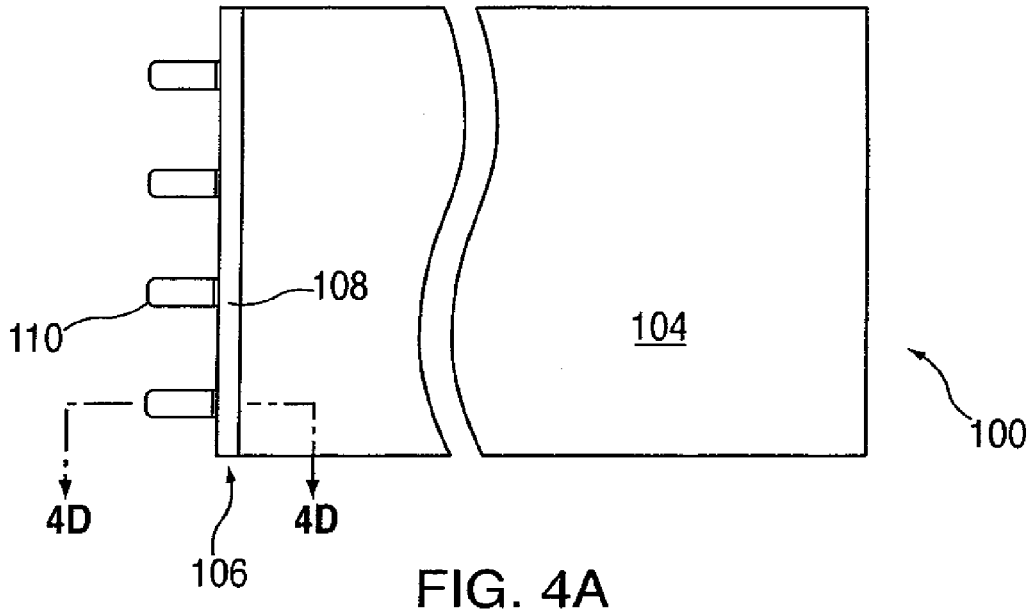
FIGS. 4A and 4B are respective top and side views of an intermediate transfer blanket in accordance with a preferred embodiment of the invention.
Figure 4D:
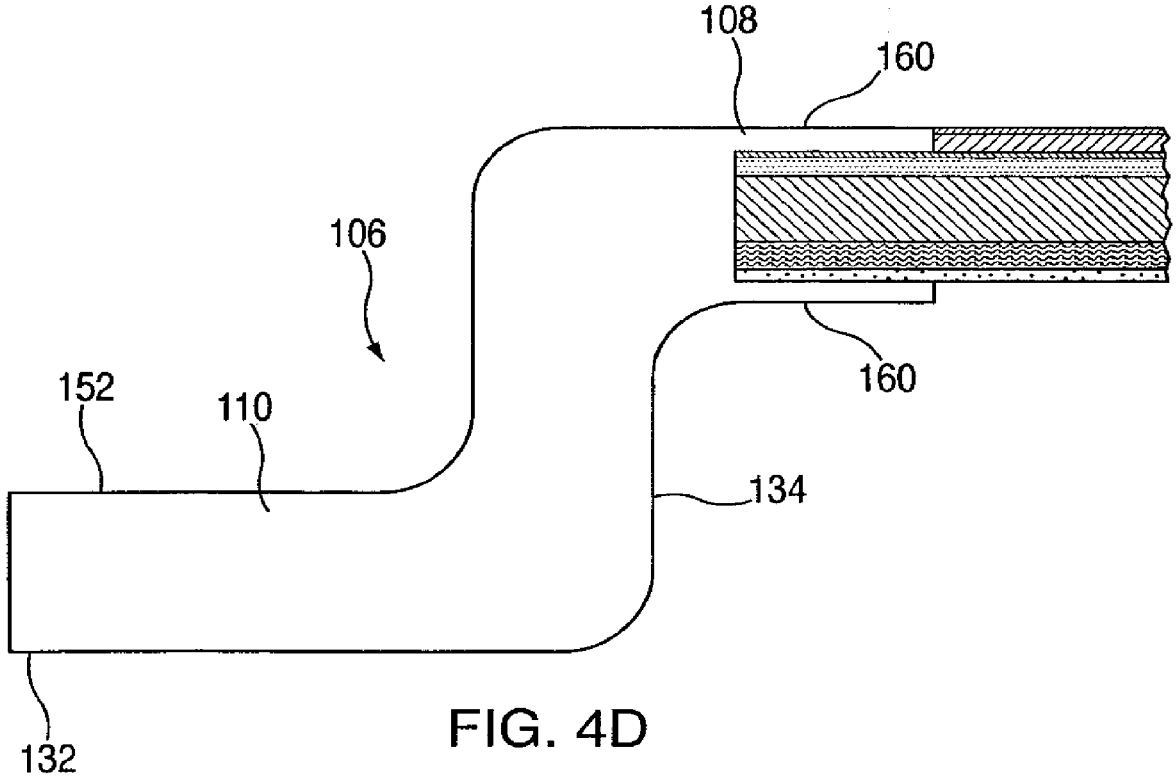
FIG. 4D is a cut-away expanded view, taken along line IV-D of FIG. 4A, of a securing mechanism on the intermediate transfer blanket of FIGS. 4A and 4B.
Figure 4B:
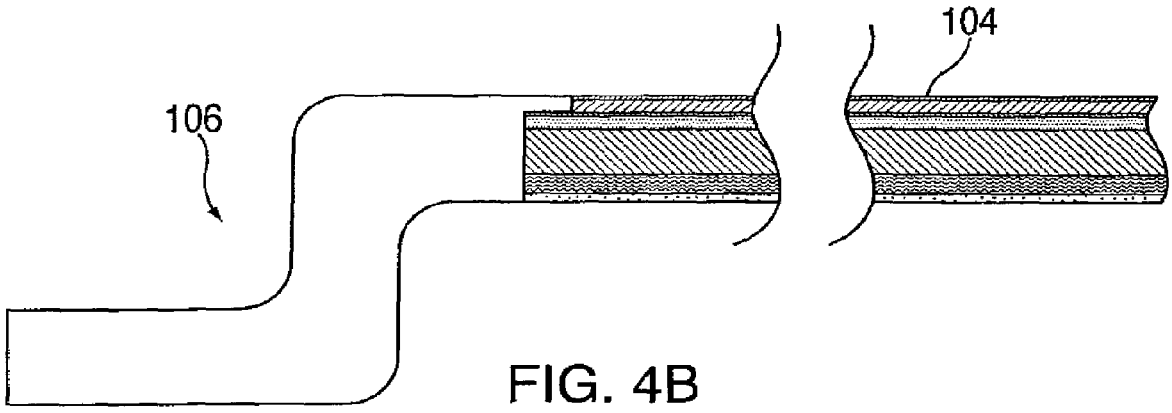
Figure 4C:
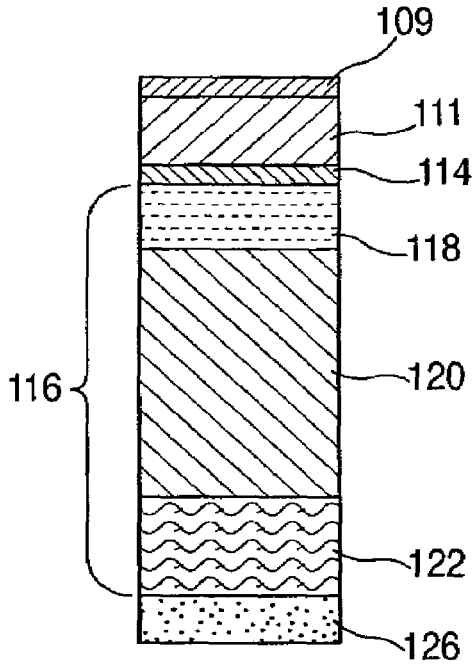
FIG. 4C shows details of the layered construction of the intermediate transfer blanket in accordance with a preferred embodiment of the invention.

FIGS. 3A, 3B and 4A-4D illustrate a preferred embodiment of intermediate transfer member 30 in accordance with a preferred embodiment of the invention. FIG. 3A shows an intermediate transfer blanket 100 mounted on a drum 102. Transfer blanket 100 (whose details are shown in FIGS. 4C and 4D) comprises a preferably layered transfer portion 104 and a mounting fitting 106.

As shown most clearly in FIG. 4C, transfer portion 104 comprises a release layer 109 which is outermost on the blanket when it is mounted on drum 102. Underlying layer 109 is a conforming layer 111 preferably of a soft elastomer, preferably of polyurethane and preferably having a Shore A hardness of less than about 65, more preferably, less than about 55, but preferably more than about 35. A suitable hardness value is between 45-55, preferably about 50. Underlying layer 111 is a conductive layer 114 which overlays a blanket body 116 comprising a top layer 118, a compressible layer 120 and a fabric layer 122. Underlying the fabric layer is an adhesive layer 126 which is in contact with drum 102.

Drum 102 is preferably heated by an internal halogen lamp heater or other heater to aid transfer of the image to and from the release layer 109 to a final substrate as is well known in the art. Other heating methods, or no heating at all, may also be used in the practice of some aspects of the invention. The degree of heating will depend on the characteristics of the toner and or ink used in conjunction with the invention.

As shown in FIGS. 4A, 4B and 4D, mounting fitting 106 comprises an elongate electrically conducting bar 108, for example of a metal such as aluminum formed with a series of L-shaped mounting legs 110 (in the form of finger-like extensions) which are also conducting, preferably of the same material as bar 108, and preferably formed integrally therewith. In particular, bar 108 is formed with a slot into which the end of layered transfer portion 104 is inserted. Preferably, the end of the layered portion which is inserted into the mounting bar does not have a release layer 109 or conforming layer 111, whereby conducting layer 114 is exposed and is therefore in electrical contact with bar 108. Alternatively, the bar 108 can be formed with sharp internal projections which pierce the outer layers of the blanket and contact the conducting layer.

Optionally, each of the layers beneath the conducting layer 114 may be partially conducting (for example, by the addition of conductive carbon black or metal fibers) and the adhesive layer may be conductive, such that current also flows directly from the drum surface to the conducting layer.

In one preferred embodiment of the invention, fitting 106 is formed of a single sheet of metal, wherein the legs are partially cut from the metal which is bent into a U shape to form the slot into which the layered portion is inserted. After insertion, the outer walls of the slot are forced against the layered portion to secure the layered portion in the slot. The partially cut out portion is bent to form the mounting legs.

In the preferred embodiment of the invention shown in FIG. 3A, drum 102 is maintained at a potential suitable for transferring images to the intermediate transfer member, for example at 500 volts, which voltage is applied, via mounting fitting 106 to conductive layer 114. Thus, the source of transfer voltage is very near the outer surface of portion 104 which allows for a lower transfer potential on the drum.

In a preferred embodiment of the invention, transfer portion 104 is fabricated by the following procedure:

1—The starting structures for blanket construction is a blanket body 116 generally similar to that generally used for printing blankets. One suitable body is MCC-1129-02 manufactured and sold by Reeves SpA, Lodovicio (Milano), Italy. Other preferred blanket types are described the parents of this application. In a preferred embodiment of the invention, body 116 comprises a fabric layer 122, preferably of woven NOMEX material and having a thickness of about 200 micrometers, a compressible layer 120, preferably comprising about 400 micrometers of saturated nitrite rubber loaded with carbon black to increase its thermal conductivity. Layer 120 preferably contains small voids (about 40-60% by volume) and a top layer 118 preferably comprised of the same material as the compressible layer, but without voids. Layer 118 is preferably about 100 micrometers thick. The blanket body is produced by manufacturing methods as are generally used for the production of offset printing blankets for ink offset printing.

Blanket body 116 is preferably sized to a relatively exact thickness by abrading portions of the surface of top layer 118. A preferred thickness for the finished body 116 is about 700 micrometers, although other thicknesses are useful, depending on the geometry of the printing system in which it is used and the exact materials used in the blanket body.

2—The fabric side of blanket body 116 is preferably coated with a 30 micrometer thick coating of silicone based adhesive (preferably, Type D 66 manufactured by Dow Corning). The adhesive is covered with a sheet of mylar coated with a fluorosilicone material, such as DP 5648 Release Paper (one side coat) distributed by H.P. Smith Inc., Bedford Park, Ill. This adhesive to characterized by its good bond to the surface of drum 102 and is resistant to the carrier liquid used in the liquid toner. The blanket may be removed from the drum, when its replacement is desired, by cutting the blanket along the edge of fitting 106 and removing the blanket and fitting.

An adhesive is used to assure good thermal contact between the bade of the blanket and the drum on which it is mounted. A silicone adhesive is used since adhesives normally used in attachment of blankets deteriorate under the heat which is generated is the underlying drum in the preferred apparatus. While the temperature of the drum varies, depending on the thermal resistance of the blanket and the desired surface temperature of the blanket (which in turn depends on the toner used in the process and the details of transfer of the toner to the final substrate), the drum temperature may reach 80° C., 100° C., 120° C. or 150° C. or more.

3—The top layer is coated with a sub-micron layer of primer before being coated with the conductive layer. A preferred primer is Dow Coming 1205 Prime Coat. The type of primer depends on the properties of the top layer and of the conductive layer. Preferably, 0.3 micron of primer is coated onto a clean top layer with a No. 0 bar in a wire coating apparatus and is allowed to dry before applying the conductive layer.

4—Conductive layer 114 is preferably formed of acrylic rubber loaded with conductive carbon black. In a preferred embodiment of the invention only 2-3 micrometers of conductive coating are required. The conductive layer is formed by first compounding 300 grams of HYTEMP 40SIEF (B.F. Goodrich) with 6 grams of HYTEMP NPC 50 (B.F. Goodrich) and 9 grams of sodium stearate in a two roll still for 20 minutes, dissolving 150 grams of the compounded material in 2000 grams of methyl ethyl ketone (MEK) by stirring for 12 hours at room temperature:.

40 grams of conductive carbon black, such as for example, Printer XE2 (Degussa) are added to the solution and the mixture is ground in a 01 attritor (Union Process) loaded with 3/16" steel balls. Grinding proceeds at 10 C for 4 hours after which time the material is diluted by the addition of MSR to a concentration of 9.5-8t solids and discharged from the grinder in the form of a conductive lacquer.

The primed blanket is overcoated with about 3 micrometers of the conductive lacquer (three passes using a No. 0 rod) and allowed to dry for 5 minutes at room temperature.

An additional coating of primer is added over the conductive lacquer (except for the portion which is to be inserted into bar 108) before the soft elastomeric conforming layer is applied.

The resistance of the conductive layer should preferably be more than about 20 kohms/square and preferably less than about 50 kohm/square. This value will depend on the resistivity of the layers above the conducting layer and on the aspect ratio of the blanket. In general, the resistance should be low enough so that the current flowing on the conducting layer (to supply leakage current through the overlying layers) should not cause a substantial variation of voltage along the surface of the blanket. The resistance of the conducting layer and, more importantly, the resistance of the overlying layers controls the current flowing through the overlying layers. Generally speaking the conductive layer has a relatively low resistance and resistivity, the conforming layer (layer 111) has a higher resistivity and the overlying release layer (layer 109) has a still higher resistivity.

5—One kg of pre-filtered FOMREZ-50 Polyurethane resin (Hagalil Company, Ashdod, Israel) is dehydrated and degassed under vacuum at 60° C. 600 grams of the degassed material is mined with 1.4 grams of di-butyl-tin-diluarate (Sigma) and degassed at room temperature for 2 hours. 30 grams of the resulting material 3.15 grams of RTV Silicone 118 (General Electric), 4.5 grams of Polyurethane cross-linker, MDI D6530 (Bayer) and are stirred together. A 100 micrometer layer of the material is coated over the primed conductive layer using a No. 3 wire rod with several passes under clean conditions, preferably, class 100 conditions. The coating is cured for two hours at roan temperature under a clean hood.

Other methods of forming suitable conforming layers are shown and described in the parents of thin application.

Layer 111 which is thus formed should have a resistance of the order of about 109 ohm-cm, good thermal stability at the working temperature of the blanket, which is preferably about 100° C. or less.

The function of the conforming layer is to provide good conformation of the blanket to the image forming surface (and the image on the image forming surface) at the low pressures used in transfer of the image from the image forming surface to the blanket. The layer should have a Shore A hardness preferably of between 25 or 30 and 65, more preferably about 50. While a thickness of 100 micrometers is preferred, other thicknesses, between 50 micrometers and 300 micrometers can be used, with 75 to 125 micrometers being preferred.

6—12 grams of RTV silicone 236 (Dow Coming) release material diluted with 2 grams of ISOPAR® L petroleum distillate (Exxon) and 0.72 grams of SYL-OFF 297 (Dow Corning) are mixed together. A wire rod (bar No. 1) coating system is used, with five or six passes, under clean conditions to achieve an 8 micrometer release layer thickness. The material is cured at 140° C. for two hours. The cured release material has a resistivity of between about $10^{14}$ and $10^{15}$ ohm-cm.

In order to mount blanket 100 on drum 102, mounting legs 110 are inserted into a plurality of mounting holes 130 formed in drum 102, preferably without removing the mylar sheet from the adhesive layer (the back of the blanket). As can be seen most clearly in FIG. 4D, mounting legs 110 each have a tip portion 132 and a back portion 134. Tips 132 are inserted into slots formed in the far sidewalls of mounting holes 130 and the back portion 134 rests against the opposite sidewall of the hole. In this way the end of the blanket is accurately positioned. The edge of the mylar sheet closest to the legs is removed and the remainder of the mylar sheet is progressively removed while making sure that the successive portions of the blanket which are thus attached to the drum by the adhesive lie flat against the drum.

The present inventors have found that this method of mounting is far superior to either adhesive mounting alone or to grippers at both ends of the blanket in providing a stable transfer surface.

As an alternative to, or additional to, the adhesive layer 126, a very soft conforming layer may be used at the back of the blanket. A soft layer of this type will allow for good thermal contact between the blanket and—the heated 102 so that the temperature of the drum need not be excessive in order for the outer surface of the blanket to reach its operating temperature. Furthermore, such a very soft layer will cause the blanket to "cling" to the drum obviating the use of adhesive under certain circumstances. Furthermore, when the blanket is replaced there is no adhesive residue on the drum to be removed.

A very soft layer may be produced by the following method:

1—100Q of HI-TEMP 4051 EP (Zeon) acrylic resin is mixed with 2 g NPC-50 crosslinker (Zeon) and 3 g sodium stearate and dissolved in toluene to give a solution of 15% non-volatile solids. Optionally, up to about 40 g of carbon black Pearls 130 (Cabot) is added.

2—A thin layer of the solution is coated onto release coated mylar and dried. This process is repeated several times until a thickness of preferably 20-30 micrometers is achieved.

3—The uncured resin is laminated to the adhesive layer of a blanket produced in accordance with the invention, or directly to the fabric layer. This step is preferably carried out prior to the cure of the release layer.

4—The laminated structure is cured together with the release layer and the release coated mylar is removed.

The layer has a Shore A hardness of about 20-24 without carbon black and about 40-45 with carbon blank. Softer materials are also suitable; however, substantially harder materials do not adhere well to the drum surface. Optionally, the adhesive layer at the trailing end of the blanket is not coated with the very soft layer to improve coherence of the blanket and the drum. This is especially desirable for harder layers.

The acrylic material may be replaced by other soft elastomer materials such as soft polyurethane or nitrile rubber. Other heat improving fillers which have a smaller effect on the hardness of the final product may be used instead of carbon black, such as $Fe_20_3$ or alpha aluminum oxide.

Figure 5:
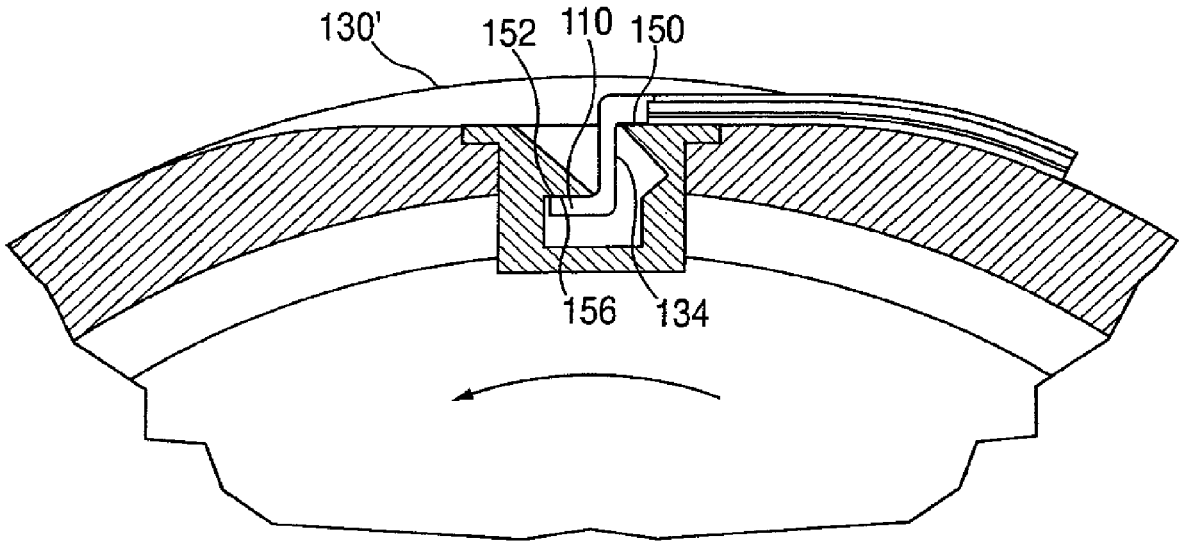
FIG. 5 is a simplified cross-sectional illustration of a portion of an intermediate transfer member, including a removable intermediate transfer blanket mounted on a drum in accordance with another preferred embodiment of the invention.

FIG. 5 shows an alternative, preferred embodiment of the invention in which somewhat different shaped holes 130' are used. In this embodiment the back portion 134 rests against a protrusion 150 formed on one side of the hole while a back surface 152 of leg 110 rests against the bottom 156 of a protrusion formed on the other side of the hole.

While the preferred electrical connection between the conductive layer and the mounting bar is preferably achieved by removing (or not forming) the layers which overly an end portion of the conductive layer, piercing the overlying layers, for example by crimping and or piercing the mounting bar for example at points marked 160 in FIG. 4D. Crimping can also be used to hold the blanket in the mounting bar.

While the adhesive layer preferably covers the back of the blanket, alternatively the adhesive layer may cover only a portion of the back such as the edge farthest away from the bracket (the trailing edge of the blanket), or may for some embodiments of the invention and under certain circumstances be omitted.

Member 30 is maintained at a suitable voltage and temperature for electrostatic transfer of the image thereto from the image bearing surface. Intermediate transfer member 30 is preferably associated with a pressure roller 71 for transfer of the image onto a final substrate 72, such as paper, preferably by heat and pressure.

Cleaning apparatus 32 is operative to scrub clean the surface of photoreceptor 12 and preferably includes a cleaning roller 74, a sprayer 76 to spray a non polar cleaning liquid to assist in the scrubbing process and a wiper blade 78 to complete the cleaning of the photoconductive surface. Cleaning roller 74 which may be formed of any synthetic resin known in the art for this purpose is driven in the same sense as drum 10 as indicated by arrow 80, such that the surface of the roller scrubs the surface of the photoreceptor. Any residual charge left on the surface of photoreceptor sheet 12 may be removed by flooding the photoconductive surface with light from optional neutralizing lamp assembly 36, which may not be required in practice.

In accordance with a preferred embodiment of the invention, after developing each image in a given color, the single color image is transferred to intermediate transfer member 30 which comprises a transfer blanket 100 preferably mounted on a drum 102. Subsequent images in different colors are sequentially transferred in alignment with the previous image onto intermediate transfer member 30. When all of the desired images have been transferred thereto, the complete multi-color image is transferred from transfer member 30 to substrate 72. Impression roller 71 only produces operative engagement between intermediate transfer member 30 and substrate 72 when transfer of the composite image to substrate 72 takes place. Alternatively, each single color image is separately transferred to the substrate via the intermediate transfer member. In this case, the substrate is fed through the machine once for each color or is held on a platen and contacted with intermediate transfer member 30 during image transfer.

Drum 102 is preferably heated by an internal halogen lamp heater or other heater to aid transfer of the image to and from the release layer 109 (FIG. 6) to a final substrate as is well known in the art. Other heating methods, or no heating at all may also be used in the practice of some aspects of the invention. The degree of heating will depend on the characteristics of the toner and or ink used in conjunction with the invention.

Figure 6:
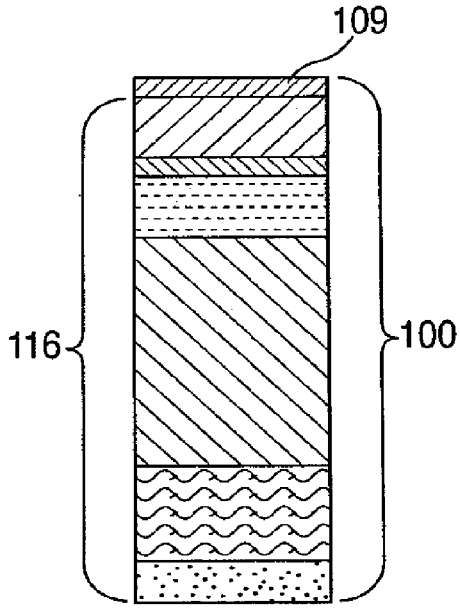
FIG. 6 shows a layered intermediate transfer blanket in accordance with a preferred embodiment of the invention.

FIG. 6 illustrates the salient feature of intermediate transfer member 30 in accordance with a preferred embodiment of the invention. FIG. 6 shows a cross section of a multi-layer intermediate transfer mounted on a drum 102. Transfer blanket 100 (whose details are given in the above mentioned EDAN patent application, but which are not particularly relevant to the present invention) has, as a salient feature, a layered base portion 116 and release layer 109 that receives the liquid toner images from the intermediate transfer member and from which they are transferred to the final substrate.

In a preferred embodiment of the invention the release layer is formed by diluting 6-12 grams of RTV silicone 236 (Dow Corning) release material with 2 grams of ISOPAR L (Exxon) and mixing the result with 0.72 grams of SYL-OFF 297 (Dow Coming). A wire rod (bar No. 1) coating system is used, with five or six passes, under clean conditions to achieve an 8 micrometer release layer thickness. The material is cured at 140° C. for two hours. The cured release material has a resistivity of between about $10^{14}$ and $10^{15}$ ohm-cm.

In a preferred embodiment of the invention, the liquid toner in reservoirs 55, 57, 59 and 61 ("the toner reservoirs") comprises approximately 1%-2% of toner particles by weight, additives as are known in the art and a relatively volatile hydrocarbon carrier liquid. This liquid can be characterized as being composed mainly of a carrier liquid that evaporates quickly and having less than 2%, preferably 0.2%-2%, more preferably 0.5%-1%, of a very slowly evaporating component. In a preferred embodiment of the invention, the carrier liquids are hydrocarbons wherein the hydrocarbon that evaporates relatively quickly has a vapor pressure at 100° F. of greater than 0.05 psia when measured according to ASTM standard D 2879 and a 95% evaporation time at room temperature of less than 10 hours, preferably, less than 6 hours and the liquid hydrocarbon that evaporates relatively slowly has an evaporation rate much greater than 10 hours. In particular, the slowly evaporating hydrocarbon has an evaporation rate of about an order of magnitude slower than that of the relatively evaporating material.

The present inventors have found that addition of such small percentages of a hydrocarbon with a low volatility results in a two to three fold increase in the lifetime of the release surface of the blanket. While this phenomena is not completely understood, it is believed that during transfer of the image, by the intermediate transfer member, to the final substrate, carrier liquid is absorbed onto the surface of—the blanket. The heating of the blanket described above causes the higher volatility component to evaporate, while leaving a coating of the lower volatility component as a protective coating on the blanket surface. While the lower volatility component is also evaporated from the blanket, due to the differences in volatility, the layer is replenished by succeeding imaging cycles so that the layer remains substantially of lower volatility component.

The use of higher proportions of low volatility component is proscribed by its effect on the quality of the fusing of the image to the final substrate, and especially by the reduction in abrasion resistance that results. On the other hand as the proportion of low volatility component decreases, the increase in life of the blanket is believed to be reduced.

In a preferred embodiment of the invention the relatively higher volatility component is ISOPAR L (EXXON) and the relatively lower volatility component is MACOL 82 (EXXON). Other high and low volatility components may be used, and the choice of component volatility and percentage in the carrier liquid will depend in some measure on the speed of the imaging process, the amount of carrier liquid in the image and background portions of the image transferred to and from the intermediate transfer member and the temperature of the member.

The small percentage of low volatility component can be incorporated into the liquid toner in a number of ways. One way is to add the desired proportion of low volatility component to the carrier liquid present in the concentrate, in the charge director concentrate and in the replenishment liquid. Alternatively, a higher percentage of low volatility component can be added to either the toner concentrate or the replenishment liquid, preferably to the replenishment liquid. It has been found that a replenishment liquid having 1% of MARCOL 82 to 99% ISOPAR L works well. Other proportions, such as 0.5% to 4% MARCOL 82 are also believed to give satisfactory results, however, between 1% and 2% Mareol 82 is preferred.

It will be appreciated by persons skilled in the art that the present invention is not limited by the description and example provided hereinabove. Rather, the scope of this invention is defined only by the claims which follow:

The invention claimed is:

1. A multicolor electrostatic imaging system comprising:

an imaging apparatus to produce one or more images on a substrate; and a toner reservoir having a liquid toner to form the one or more images, wherein the liquid toner comprises fibrous toner particles and carrier liquid;

said carrier liquid comprising, as a major or component, first liquid hydrocarbon having a first rate of evaporation, and, as a minor component, second liquid hydrocarbon having a second rate of evaporation which, at room temperature, is at least an order of magnitude less than the first rate of evaporation; and said fibrous toner particles comprising a polymer portion and pigment dispersed in said polymer portion, said polymer portion comprising a surface of said fibrous toner particles and being insoluble in said carrier liquid at temperatures below 40 degrees Celsius so that the polymer portion will not dissolve or solvate in storage, and solvatable by said carrier liquid only at temperatures above 50 degrees Celsius.

2. The multicolor electrostatic imaging system as recited in claim 1, wherein the major component has a vapor pressure at 100 degrees Fahrenheit greater than 0.05 psia when measured according to ASTM standard D 2879.

3. The multicolor electrostatic imaging system as recited in claim 2, wherein said major component is liquid hydrocarbon having a 95% evaporation time at room temperature of less than 10 hours.

4. The multicolor electrostatic imaging system as recited in claim 2, wherein said major component has a 95% evaporation time at room temperature of less than 6 hours.

5. The multicolor electrostatic imaging system as recited in claim 1, wherein said first liquid hydrocarbon and said second liquid hydrocarbon are substantially non-conducting having an electrical volume resistivity in excess of $10^9$ ohm-cm and a dielectric constant below 3.0.

6. The multicolor electrostatic imaging system as recited in claim 1, wherein the fibrous toner particles comprise approximately 1 to 2% of the liquid toner in the toner reservoir by weight.

7. The multicolor electrostatic imaging system as recited in claim 1, wherein the imaging apparatus comprises an intermediate transfer member having a release outer layer to receive toner from the imaging surface and to solvate carrier liquid the received toner.

* * * * *

UNITED STATES PATENT AND TRADEMARK OFFICE

CERTIFICATE OF CORRECTION

PATENT NO. : 7,647,008 B2
APPLICATION NO. : 11/933124
DATED : January 12, 2010
INVENTOR(S) : Landa et al.

It is certified that error appears in the above-identified patent and that said Letters Patent is hereby corrected as shown below:

Column 14, line 16, after "major" delete "or".

Column 14, line 54, after "liquid" delete "within".

Signed and Sealed this

Seventh Day of September, 2010

David J. Kappos

David J. Kappos
*Director of the United States Patent and Trademark Office*